United States Patent [19]

Macdonald

[11] Patent Number: 4,912,790

[45] Date of Patent: Apr. 3, 1990

[54] FITTED BED SHEETS

[76] Inventor: Robert Macdonald, R.R. #1, Perth, Canada

[21] Appl. No.: 230,258

[22] Filed: Aug. 9, 1988

[30] Foreign Application Priority Data

Aug. 14, 1987 [CA] Canada ..... 544,584

[51] Int. Cl.[4] ..... A47G 9/04

[52] U.S. Cl. ..... 5/497; 5/499

[58] Field of Search ..... 5/497, 496, 495, 499

[56] References Cited

U.S. PATENT DOCUMENTS

| | | | |
|---|---|---|---|
| 3,111,688 | 11/1963 | Barnes | 5/497 |
| 4,237,805 | 12/1980 | Ferrante | 5/497 X |
| 4,422,195 | 12/1983 | Rosso et al. | 5/495 |
| 4,672,702 | 6/1987 | Isham | 5/497 |
| 4,698,865 | 10/1987 | Walker | 5/497 |
| 4,703,530 | 11/1987 | Gusman | 5/497 |
| 4,727,608 | 3/1988 | Joyce | 5/497 |
| 4,744,118 | 5/1988 | Lunt | 5/497 |
| 4,777,677 | 10/1988 | Dugan | 5/497 |

*Primary Examiner*—Gary L. Smith
*Assistant Examiner*—Michael J. Milano
*Attorney, Agent, or Firm*—Jeffers, Hoffman & Niewyk

[57] ABSTRACT

A fitted bed sheet includes a substantially rectangular main body portion of substantially the same dimensions as a selected mattress. Side portions extend from the sides of the main body portion and terminate in longitudinal edges. End portions extend from the ends of the main body portion and terminate in end edges. Substantially vertical corner seams join the side portions to the adjacent end portions, each seam extending from an inner end at a corner of said main body portion to an outer end at the junction of a longitudinal edge and an end edge. The side edges and end edges are thereby joined together to define a perimeter. There is elastic in at least a portion of the perimeter, to permit the sheet to fit snuggly around a mattress. The present invention is particularly characterized in that the vertical corner seams are at least partly elasticized.

9 Claims, 2 Drawing Sheets

FITTED BED SHEETS

BACKGROUND OF THE INVENTION

The present invention relates to the field of bed sheets. In particular, the present invention provides a novel method of manufacturing a fitted sheet, and novel sheets produced by that method.

Fitted sheets, in general, are sheets which are sewn to fit snuggly on a mattress, with sewn corners corresponding to the corners of a mattress. Usually, the ends of a fitted sheet, between the sewn corners, are provided with a sewn-in elastic. Alternatively, an elastic may be sewn-in around the perimeter of the sheet, connecting all four sewn corners, or a short piece of elastic may be sewn at each corner, extending a short distance in each of the length-wise and width-wise directions. In each case mentioned, however, a two-step process is followed: the corners are sewn to create a box-like arrangement, and then elastic is applied as noted above, to at least a portion of the perimeter. This is a labour-intensive operation, and fairly time consuming.

The object of the present invention is to provide a novel fitted sheet construction and a manufacturing technique for same.

In one broad aspect, the present invention relates to a fitted bed sheet including: (i) a substantially rectangular main body portion of substantially the same dimensions as a selected mattress; (ii) side portions extending from the sides of said main body portion and terminating in longitudinal edges; (iii) end portions extending from the ends of said main body portion and terminating in end edges; and (iv) substantially vertical corner seams joining the side portions to the adjacent end portions, each seam extending from an inner end at a corner of said main body portion to an outer end at the junction of a longitudinal edge and an end edge, said side edges and end edges thereby being joined together to define a perimeter. The bed sheet to which the present invention relates is provided with elastic in at least a portion of said perimeter, to permit said sheet to fit snuggly around a mattress. The fitted bed sheet of the present invention is characterized in that said vertical corner seams are at least partly elasticized.

The fitted bed sheet of the present invention, in an advantageous embodiment, is further characterized in that said end edges are the portion of said perimeter which is elasticized. Furthermore, said vertical seams may be elasticized along their entire length. In one embodiment, said side and end portions are substantially rectangular with lateral edges which are sewn together to form said seams. Moreover, said elasticized vertical seams, in a fully stretched condition, will preferably be longer than the thickness of the said selected mattress. Preferably, said vertical seams are elasticized by means of elastic material sewn into each end of said sheet, a piece of said elastic material being sewn, in a stretched condition, from the inner end of a vertical seam, down the seam, across the adjacent end edge and up the other vertical seam adjacent to that end edge.

In another embodiment, said side portions are trapazoidal, and said end portion is substantially rectangular, but outwardly extended, thereby to form a pocket upon installation of said elastic.

In another broad aspect, the present invention relates to a method of manufacturing a fitted bed sheet, comprising the steps of: (a) providing a cut piece of material including: (i) a substantially rectangular main body portion of substantially the same dimensions as a selected mattress; (ii) side portions extending from the sides of said main body portion and terminating in longitudinal edges; (iii) end portions extending from the ends of said main body portion and terminating in end edges; said side and end portions being separated from one another by cut out portions defined by the lateral edges of the side and end portions; (b) folding said material on a line bisecting a said cut-out, so that a lateral edge of a said side portion is aligned with a lateral edge of an adjacent end portion; (c) folding said material on a line bisecting the cut-out adjacent the opposite end of the same end portion, so that the lateral edge of the other side portion is aligned with the lateral edge of the end portion; (d) sewing on elastic, in a stretched condition from one set of aligned lateral edges, along the adjacent end edge to the other aligned set of lateral edges, thereby to sew vertical seams between said side and end portions, said vertical seams being at least partially elasticized; (e) repeating steps (c) and (d) at the opposite end of the material, to obtain a fitted sheet.

In a preferred form of this method said vertical seams are elasticized along their entire length.

According to one way of carring out the method of the present invention, said side and end portions are substantially rectangular, and said cut-outs are substantially square.

However, according to another way of carring out the present invention, said side sections are substantially trapazoidal, said end sections are substantially rectangular, and said cut-outs are substantially triangular.

DESCRIPTION OF THE DRAWINGS

In drawings which illustrate the present invention by way of example.

DETAILED DESCRIPTION

Figure 1:
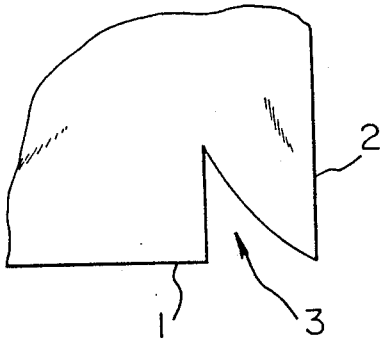
FIG.1 PRIOR ART
FIG. 1 is a plan view of one corner of a typical pattern for manufacturing a fitted sheet according to the prior art.
Figure 2:
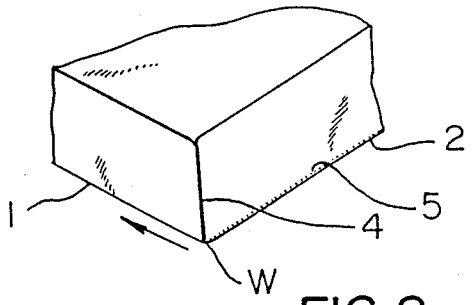
FIG. 2 PRIOR ART
FIG. 2 is a perspective view of one corner of a prior art fitted sheet ob a mattress.

With reference first to the prior art, as typified by FIGS. 1 and 2, it will be seen that the basic fitted bed sheet pattern provides for opposed longitudinal edges 1—(only one of which is shown), into which notches 3 are cut, and shorter, lateral or end edges 2—(only one of which is shown). The sides of the notches are sewn together to form fitted corners, in the first stage of manufacture of a typical fitted sheet. Then, elastic 5 is sewn along the lateral edge 2. The elastic is, of course, stretched prior to being sewn into the edge, so that the sheet will fit snuggly onto a mattress onto which it is placed. In the example illustrated, elastic 5 is sewn into the end edge 2 only, but it may be sewn around the entire perimeter of the sheet, or in the corner regions only, with similar results As can be seen by the arrow in FIG. 2, when a fitted sheet is tensioned, for instance by the weight of a person lying on it, there will be forces pulling along the longitudinal edges 1 of the sheet, away from the corners. Since there is no elasticity in the seam of the sewn corner 4, this seam has a tendency to rip at its junction W with the longitudinal 1 and lateral 2 edges.

Figure 3:
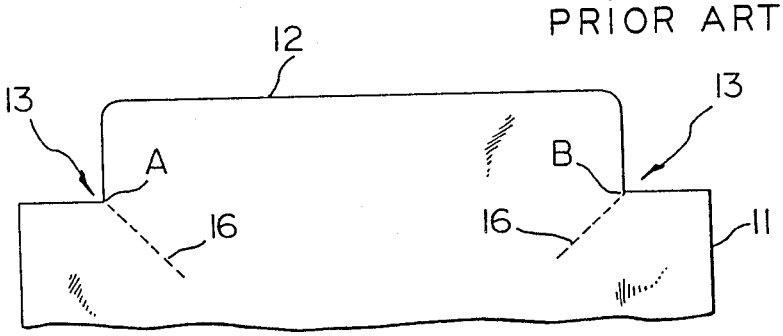
FIG. 3 is a plan view of one end of a pattern for a fitted sheet according to the first embodiment of the present invention.

Referring next to FIG. 3, a pattern for making a first embodiment of the present invention is shown. The pattern shown in FIG. 1 includes long edges 11, end edges 12 and substantially square corner cut-outs 13. It will be understood that while the corner cut-outs are square in a preferred embodiment, for ease of folding and sewing, they may be any other suitable shape, such as the notch shape of the prior art, shown in FIG. 1.

Figure 4:
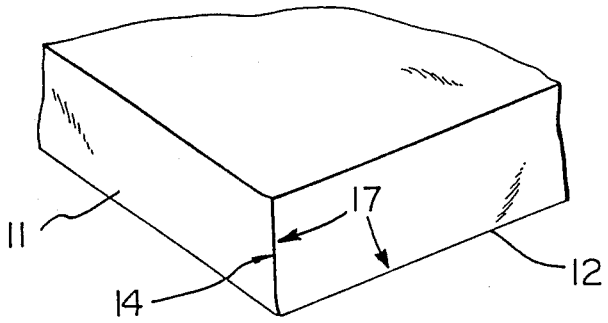
FIG. 4 is a perspective view of one corner of a fitted sheet made from the pattern of FIG. 3, on a mattress.

To manufacture the sheet of the present invention (the corner of which is shown in FIG. 4), first a sheet blank, cut from the pattern of FIG. 3, is folded at one end along fold lines 16. These fold lines are, of course, only shown for illustrative purposes, and are the lines bisecting the angle of the cut-out, extended into the body of the sheet. When folded along the fold lines, the sides of the cut-out become aligned. An elastic 17 is then stretched and aligned with the sides of the cut-out and whilst the elastic 17 is in a stretched condition, it is sewn into the sheet, from the inner end of one cut-out (shown at A) down the associated corner seam 14, across the end edge 12 and up the laterally opposite corner seam (B). It will be seen, then, that in one sewing operation, the two corners of one end of the fitted sheet are finished, and an elastic is installed in the end. Moreover, the elastic is also installed in the corner seam, so that if the corner is tensioned, it will give elastically, rather than rip. In this regard, it will be understood that the length of the sides of the cut-out 13, ought to be longer than the thickness of the mattress for which the particular fitted sheet being manufactured is intended. This is so the corner seam can contract elastically after the sheet is fitted over the mattress, to snuggly engage the corner of the mattress and also ensure that there is some slack in the corner seam so that the seam can give elastically when tensioned.

Figure 5:
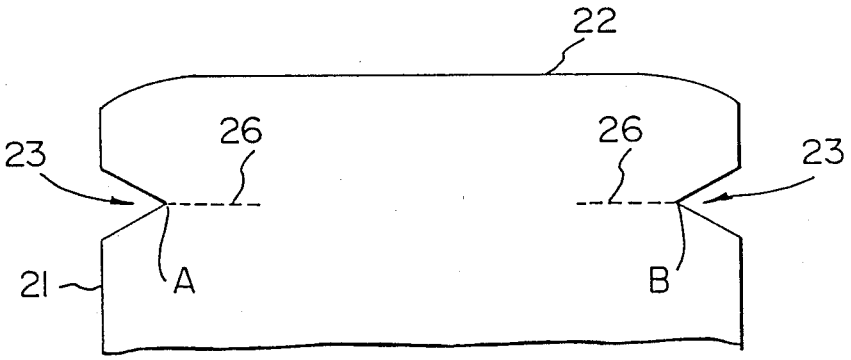
FIG. 5 is a plan view of one end of a pattern for a fitted sheet according to a second embodiment of the present invention.

Referring next to FIG. 5, a second embodiment of the pattern of the present invention is shown. In this embodiment, the cut-outs 23 are notch-shaped, and, instead of being followed directly by a straight end edge as in the previously described embodiment, the cut-out is followed by a short longitudinal extension, which is then followed by the end edge 22. The fold-line 26 still bisects the cut-out, though, and sewing is in one step per end, from the inner end of one cut-out, to the inner end of the opposite cut-out. The resultant sheet is provided with a bag-like pocket at each end. This type of sheet may be manufactured from narrower material than that of FIGS. 3 and 4. That is, the bag like pocket at each end of the sheet may be fitted around the end of a mattress, while the sides of the sheet do not extend down to the lower edges of the sides 21 of the mattress. This results in an economical fitted sheet which cannot come off the mattress accidentally to create a dangerous trap for an infant capable of crawling under a sheet but not, perhaps, of extracating itself.

It is to be understood that the examples described above are not meant to limit the scope of the present invention. It is expected that numerous variants will be obvious to the person skilled in the garment and linens manufacturing art, without any departure from the spirit of the present invention. The appended claims, properly construed, form the only limitation upon the scope of the present invention.

The embodiments of the invention in which an exclusive property or privilege is claimed are defined as follows:

1. A fitted bed sheet comprising:

a substantially rectangular main body portion having substantially the same dimensions as a selected mattress;

side portions extending from sides of said main body portion and terminating in longitudinal edges;

end portions extending from ends of said main body portion and terminating in end edges;

substantially vertical corner seams joining said side portions to adjacent said end portions, each seam extending from an inner end at a corner of said main body portion to an outer end at a junction of a longitudinal edge and an end edge, said side edges and said end edges thereby being joined together to define a perimeter; and elastic attached at said end edges of said perimeter, to permit said sheet to fit snugly around said selected mattress;

said vertical corner seams being at least partly elasticized by a single only piece of elastic material extending from a first selected point on a first said corner seam, down said first seam, across an adjacent said end edge and up an opposite second said corner seam to a second selected point.

2. A fitted bed sheet as described in claim 1, wherein said vertical seams are elasticized along their entire length.

3. A fitted bed sheet as described in claim 2 wherein said side and end portions are substantially rectangular with lateral edges which are sewn together to form said seams.

4. A fitted bed sheet as described in claim 3, wherein said elasticized vertical means, in a fully stretched condition, are longer than the thickness of said selected mattress.

5. A fitted bed sheet as described in claim 4, wherein said vertical seams are elasticized by elastic material sewn into each end of said sheet, a piece of said elastic material being sewn, in a stretched condition, from the inner end of a first vertical seam, down said first seam, across an adjacent said end edge and up a second said vertical seam adjacent to said adjacent end edge.

6. A method of manufacturing a fitted bed sheet, comprising the steps of:

providing a cut piece of material, said material including:

a substantially rectangular main body portion of substantially the same dimensions as a selected mattress, side portions extending from sides of said main body portion and terminating in longitudinal edges, end portions extending from ends of said main body portion and terminating in end edges, said side and end portions being separated from one another by cut-out portions defined by lateral edges of said side and end portions;

folding said material on a first line bisecting a first said cut-out, so that a first lateral edge of a first said side portion is aligned with a first lateral edge of a first adjacent said end portion;

folding said material on a second line bisecting a second said cut-out adjacent a second lateral edge of said first end portion, so that a first lateral edge of a second side portion is aligned with said second lateral edge of said first end portion;

sewing on a single only piece of elastic, in a stretched condition from said aligned lateral edges of said first cut-out, along said adjacent first end edge to said aligned lateral edges of said second cut-out, thereby to sew first and second vertical seams between said first and second side portions and said first end portion, said first and second vertical seams being at least partially elasticized;

folding said material on a third line bisecting a third said cut-out, so that a second lateral edge of said first said side portion is aligned with a first lateral edge of a second adjacent said end portion;

folding said material on a fourth line bisecting a fourth said cut-out adjacent a second lateral edge of said second end portion, so that a second lateral edge of said second side portion is aligned with said second lateral edge of said second end portion; and sewing on elastic, in a stretched condition from said aligned lateral edges of said third cut-out, along said adjacent second end edge to said aligned lateral edges of said fourth cut-out, thereby to sew third and fourth vertical seams between said first and second side portions and said second end portion, said third and fourth vertical seams being at least partially elasticized;

whereby a fitted sheet is obtained.

7. A method as described in claim 6, wherein said vertical seams are elasticized along their entire length.

8. A method as described in claim 6, wherein said side and end portions are substantially rectangular, and said cut-outs are substantially square.

9. A method as described in claim 6, wherein said side sections are substantially trapezoidal, said end sections are substantially rectangular, and said cut-outs are substantially triangular.

* * * * *